US010262605B2

(12) United States Patent
Herranz et al.

(10) Patent No.: US 10,262,605 B2
(45) Date of Patent: Apr. 16, 2019

(54) ELECTRONIC DISPLAY COLOR ACCURACY COMPENSATION

(71) Applicant: Apple Inc., Cupertino, CA (US)

(72) Inventors: Adria Fores Herranz, San Jose, CA (US); Guy Côté, Aptos, CA (US); Arthur L. Spence, San Jose, CA (US); Mahesh B. Chappalli, San Jose, CA (US); Peter F. Holland, Los Gatos, CA (US); Ross Thompson, Los Gatos, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/699,366

(22) Filed: Sep. 8, 2017

(65) Prior Publication Data

US 2019/0080656 A1 Mar. 14, 2019

(51) Int. Cl.
*G09G 3/20* (2006.01)
*G09G 3/36* (2006.01)

(52) U.S. Cl.
CPC ..... *G09G 3/3607* (2013.01); *G09G 3/2003* (2013.01); *G09G 2320/029* (2013.01); *G09G 2320/0233* (2013.01); *G09G 2320/0242* (2013.01); *G09G 2320/0666* (2013.01)

(58) Field of Classification Search
CPC ..... G09G 2320/041; G09G 2320/0666; G09G 2320/0242; G09G 5/06; H04N 9/3182
See application file for complete search history.

(56) References Cited

U.S. PATENT DOCUMENTS

| | | | | |
|---|---|---|---|---|
| 9,117,400 | B2 * | 8/2015 | Chaji | G09G 3/3208 |
| 2004/0183813 | A1 | 9/2004 | Edge | |
| 2007/0222724 | A1 * | 9/2007 | Ueno | G09G 3/3648 345/87 |
| 2013/0093783 | A1 | 4/2013 | Sullivan et al. | |
| 2013/0093917 | A1 * | 4/2013 | Zhang | H04N 9/73 348/223.1 |
| 2014/0267784 | A1 | 9/2014 | Chen et al. | |
| 2016/0273382 | A1 | 1/2016 | Chaji et al. | |

OTHER PUBLICATIONS

International Search Report and Written Opinion for PCT Application No. PCT/US2018/040763 dated Sep. 17, 2018; 13 pgs.

* cited by examiner

*Primary Examiner* — Antonio A Caschera
(74) *Attorney, Agent, or Firm* — Fletcher Yoder PC

(57) ABSTRACT

Systems, methods, and non-transitory media are presented that provide for improving color accuracy. An electronic display includes a display region having multiple pixels each having multiple subpixels. The electronic device also includes a display pipeline coupled to the electronic display. The display pipeline is configured to receive image data and perform white point compensation on the image data to compensate for a current drop in the display to cause the display to display a target white point when displaying white. The display pipeline also is configured to correct white point overcompensation on the image data to reduce possible oversaturation of non-white pixels using the white point compensation. Finally, the display pipeline is configured to output the compensated and corrected image data to the electronic display to facilitate displaying the compensated and corrected image data on the display region.

20 Claims, 11 Drawing Sheets

ELECTRONIC DISPLAY COLOR ACCURACY COMPENSATION

BACKGROUND

The present disclosure relates generally to electronic displays and, more particularly, to gain applied to display an image or image frame on an electronic display.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic devices often use electronic displays to provide visual representations of information by displaying one or more images. Such electronic devices may include computers, mobile phones, portable media devices, tablets, televisions, virtual-reality headsets, and vehicle dashboards, among many others. To display an image, an electronic display may control light emission from display pixels based at least in part on image data, which indicates target characteristics of the image. The electronic displays may be calibrated to compensate for a current drop due to resistance on a path from a power supply, such as a power management integrated circuit (PMIC), to the electronic display. The compensation may be determined and/or tuned based on a white point for the electronic display. However, this compensation may result in overcompensation for non-white colors resulting in oversaturation of at least some colors.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to improving perceived image quality on an electronic display. To display an image, the electronic display may control light emission from its display pixels based at least in part on image data that indicates target characteristics (e.g., luminance) at image pixels in the image. In some instances, the image data may be generated by an image data source.

An electronic display may experience display variations based on resistance of connections between a power supply and emissive elements of the display (e.g., current drop). To correct for these display variations, the electronic device (e.g., including the display) may be set to drive levels to produce a target white point for white pixels. However, nonwhite pixels may be oversaturated. Furthermore, color accuracy of the display may be decreased by cross-talk on an emissive element from data signals for other emissive elements in the display.

To address white color overcompensation and/or other cross-talk, a multi-dimensional color lookup table (CLUT) to convert incoming image data into compensated and/or corrected image data. For example, the CLUT may be populated to map incoming data values to correct for upcoming white point overcompensation. In other words, the mapping may be used to invert the overcompensation.

The usage of the CLUT enables correction of non-linear white point overcompensation by choosing values that undue overcompensation that are mapped using empirical data and/or calculations. Furthermore, the mapping in the CLUT may account for data values adjacent channels that may cause cross-talk between the emissive element data paths to compensate for the cross-talk by reducing or eliminating cross-talk-based color inaccuracies. In other words, empirical data reflecting cross-talk variations may be input into the CLUT to adjust a subpixel based on other subpixels, such as pixel values (e.g., including multiple subpixel values) of a pixel and/or adjacent pixels.

BRIEF DESCRIPTION OF THE DRAWINGS

Various aspects of this disclosure may be better understood upon reading the following detailed description and upon reference to the drawings in which.

DETAILED DESCRIPTION

Figure 1:
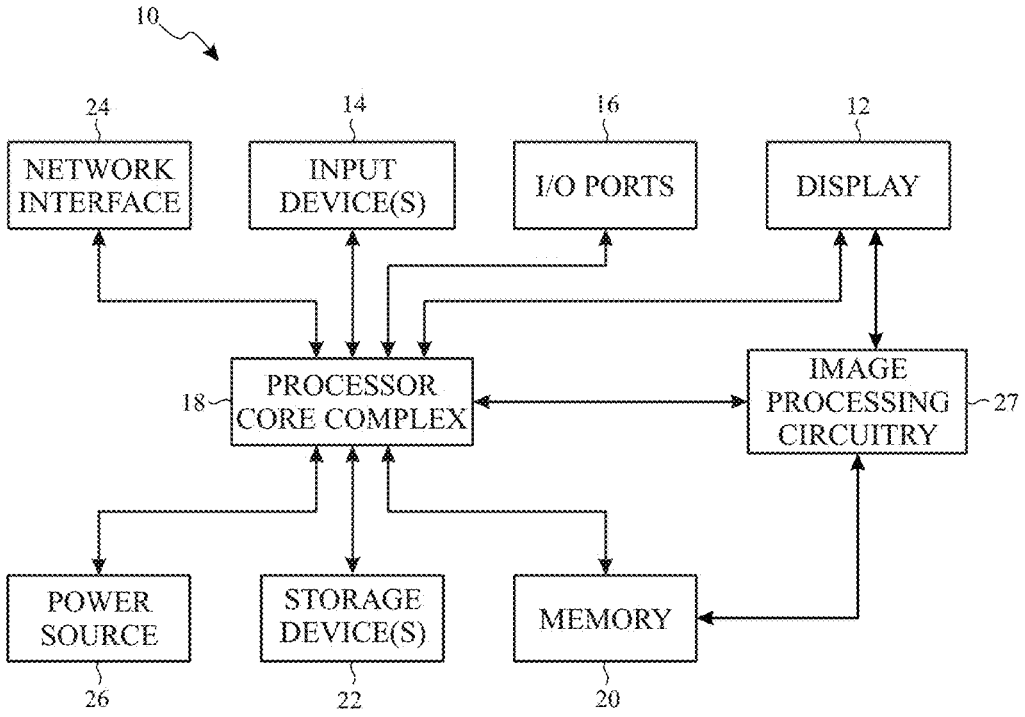
FIG. 1 is a block diagram of an electronic device including an electronic display to display images, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure generally relates to electronic displays, which may be used to present visual representations of information, for example, as images in one or more image frames. To display an image, an electronic display may control light emission from its display pixels based at least in part on image data that indicates target characteristics of the image. For example, the image data may indicate target luminance (e.g., brightness) of specific color components in a portion (e.g., image pixel) of the image, which when blended (e.g., averaged) together may result in perception of a range of different colors.

An electronic display may experience display variations based on resistance of connections between a power supply and emissive elements of the display (e.g., current drop). To correct for these display variations, the electronic device (e.g., including the display) may be set to drive levels to produce a target white point for white pixels. However, nonwhite pixels may be oversaturated. Furthermore, color accuracy of the display may be decreased by cross-talk on an emissive element from data signals for other emissive elements in the display.

To address white color overcompensation and/or other cross-talk, a multi-dimensional color lookup table (CLUT) to convert incoming image data into compensated and/or corrected image data. For example, the CLUT may be populated to map incoming data values to correct for upcoming white point overcompensation. In other words, the mapping may be used to invert the overcompensation. The usage of the CLUT enables correction of non-linear white point overcompensation by choosing values that undue overcompensation that are mapped using empirical data and/or calculations. Furthermore, the mapping in the CLUT may account for data values adjacent channels that may cause cross-talk between the emissive element data paths to compensate for the cross-talk by reducing or eliminating cross-talk-based color inaccuracies. In other words, empirical data reflecting cross-talk variations may be input into the CLUT to adjust a subpixel based on other subpixels, such as pixel values (e.g., including multiple subpixel values) of a pixel and/or adjacent pixels.

In some embodiments, tone compensation, brightness compensation, device-specific calibrations, and linear accessibility filters may also be used to select values to populate the CLUT to map incoming data to corrected and/or compensated data. Additionally or alternatively, device-specific calibrations, brightness compensations, linear accessibility filters, and/or tone compensation may be performed in other parts of a display pipeline including the CLUT.

Furthermore, the CLUT may be any suitable size. For example, the size of the CLUT may be based on a number available colors for the electronic display and/or other parameters. Moreover, the number of dimensions of the CLUT may be set according to a number of indexes used to lookup data. For example, if a subpixel value is to be compensated and/or corrected from a pixel having three subpixels, the CLUT may have at least three dimensions.

With the foregoing in mind, one embodiment of an electronic device 10 that utilizes an electronic display 12 is shown in FIG. 1. As will be described in more detail below, the electronic device 10 may be any suitable electronic device, such as a handheld electronic device, a tablet electronic device, a notebook computer, and the like. Thus, it should be noted that FIG. 1 is merely one example of a particular implementation and is intended to illustrate the types of components that may be present in the electronic device 10.

In the depicted embodiment, the electronic device 10 includes the electronic display 12, input devices 14, input/output (I/O) ports 16, a processor core complex 18 having one or more processor(s) or processor cores, local memory 20, a main memory storage device 22, a network interface 24, a power source 26, and image processing circuitry 27. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components. For example, the local memory 20 and the main memory storage device 22 may be included in a single component. Additionally, the image processing circuitry 27 (e.g., a graphics processing unit) may be included in the processor core complex 18.

As depicted, the processor core complex 18 is operably coupled with local memory 20 and the main memory storage device 22. In some embodiments, the local memory 20 and/or the main memory storage device 22 may be tangible, non-transitory, computer-readable media that store instructions executable by the processor core complex 18 and/or data to be processed by the processor core complex 18. For example, the local memory 20 may include random access memory (RAM) and the main memory storage device 22 may include read only memory (ROM), rewritable non-volatile memory such as flash memory, hard drives, optical discs, and the like.

In some embodiments, the processor core complex 18 may execute instruction stored in local memory 20 and/or the main memory storage device 22 to perform operations, such as generating source image data. As such, the processor core complex 18 may include one or more general purpose microprocessors, one or more application specific processors (ASICs), one or more field programmable logic arrays (FPGAs), or any combination thereof.

As depicted, the processor core complex 18 is also operably coupled with the network interface 24. Using the network interface 24, the electronic device 10 may be communicatively coupled to a network and/or other electronic devices. For example, the network interface 24 may connect the electronic device 10 to a personal area network (PAN), such as a Bluetooth network, a local area network (LAN), such as an 802.11x Wi-Fi network, and/or a wide area network (WAN), such as a 4G or LTE cellular network. In this manner, the network interface 24 may enable the electronic device 10 to transmit image data to a network and/or receive image data from the network.

Additionally, as depicted, the processor core complex 18 is operably coupled to the power source 26. In some embodiments, the power source 26 may provide electrical power to operate the processor core complex 18 and/or other components in the electronic device 10. Thus, the power source 26 may include any suitable source of energy, such as a rechargeable lithium polymer (Li-poly) battery and/or an alternating current (AC) power converter.

Furthermore, as depicted, the processor core complex 18 is operably coupled with I/O ports 16 and the input devices 14. In some embodiments, the I/O ports 16 may enable the electronic device 10 to interface with various other electronic devices. Additionally, in some embodiments, the input devices 14 may enable a user to interact with the electronic device 10. For example, the input devices 14 may include buttons, keyboards, mice, trackpads, and the like. Additionally or alternatively, the electronic display 12 may include touch sensing components that enable user inputs to the electronic device 10 by detecting occurrence and/or position of an object touching its screen (e.g., surface of the electronic display 12).

In addition to enabling user inputs, the electronic display 12 may facilitate providing visual representations of information by displaying images (e.g., in one or more image frames). For example, the electronic display 12 may display a graphical user interface (GUI) of an operating system, an application interface, text, a still image, or video content. To facilitate displaying images, the electronic display 12 may include a display panel with one or more display pixels. Additionally, each display pixel may include one or more subpixels, which each control luminance of one color component (e.g., red, blue, or green).

As described above, the electronic display 12 may display an image by controlling luminance of the subpixels based at least in part on corresponding image data (e.g., image pixel image data and/or display pixel image data). In some embodiments, the image data may be received from another electronic device, for example, via the network interface 24 and/or the I/O ports 16. Additionally or alternatively, the image data may be generated by the processor core complex 18 and/or the image processing circuitry 27.

Figure 2:
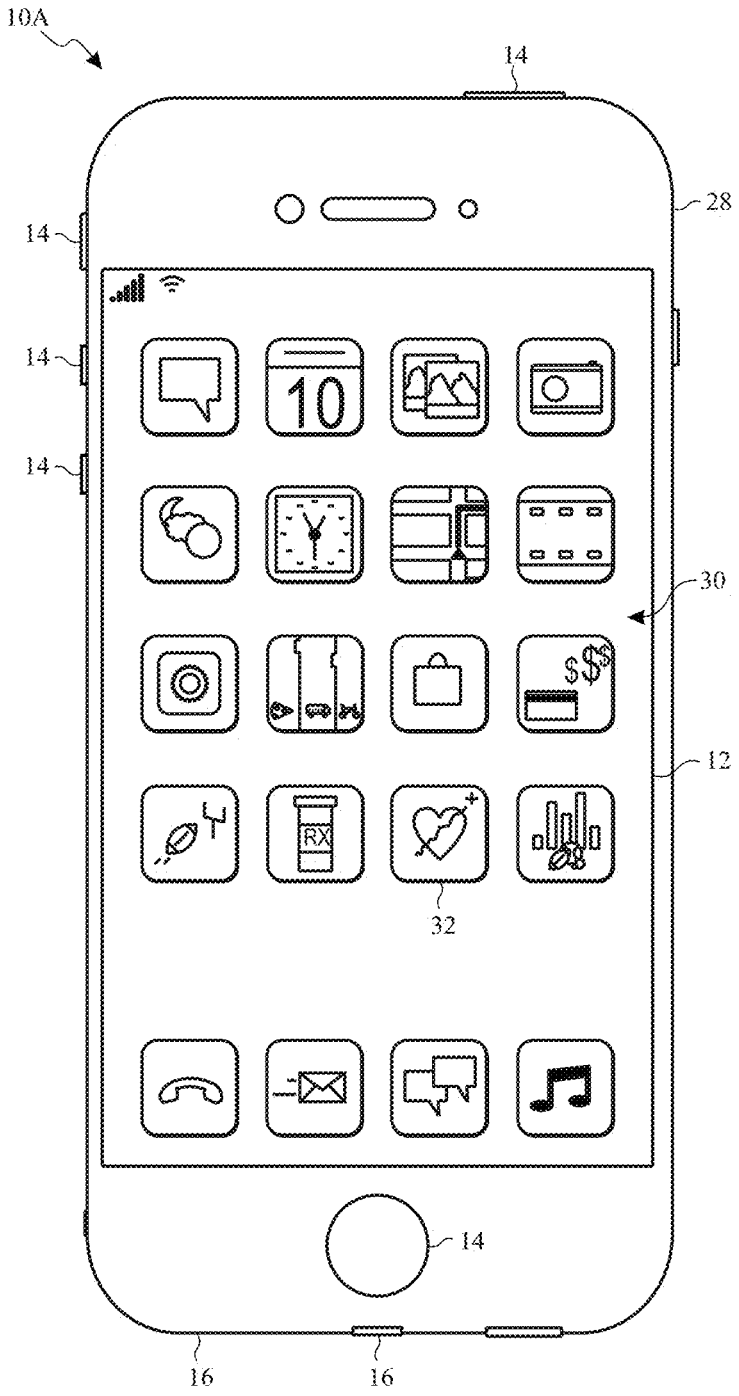
FIG. 2 is an example of the electronic device of FIG. 1, in accordance with an embodiment.

As described above, the electronic device 10 may be any suitable electronic device. To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For example, the handheld device 10A may be a smart phone, such as any IPHONE® model available from APPLE INC.

As depicted, the handheld device 10A includes an enclosure 28 (e.g., housing). In some embodiments, the enclosure 28 may protect interior components from physical damage and/or shield them from electromagnetic interference. Additionally, as depicted, the enclosure 28 surrounds the electronic display 12. In the depicted embodiment, the electronic display 12 is displaying a graphical user interface (GUI) 30 having an array of icons 32. By way of example, when an icon 32 is selected either by an input device 14 or a touch-sensing component of the electronic display 12, an application program may launch.

Furthermore, as depicted, input devices 14 open through the enclosure 28. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. As depicted, the I/O ports 16 may also open through the enclosure 28. In some embodiments, the I/O ports 16 may include, for example, an audio jack to connect to external devices.

Figure 3:
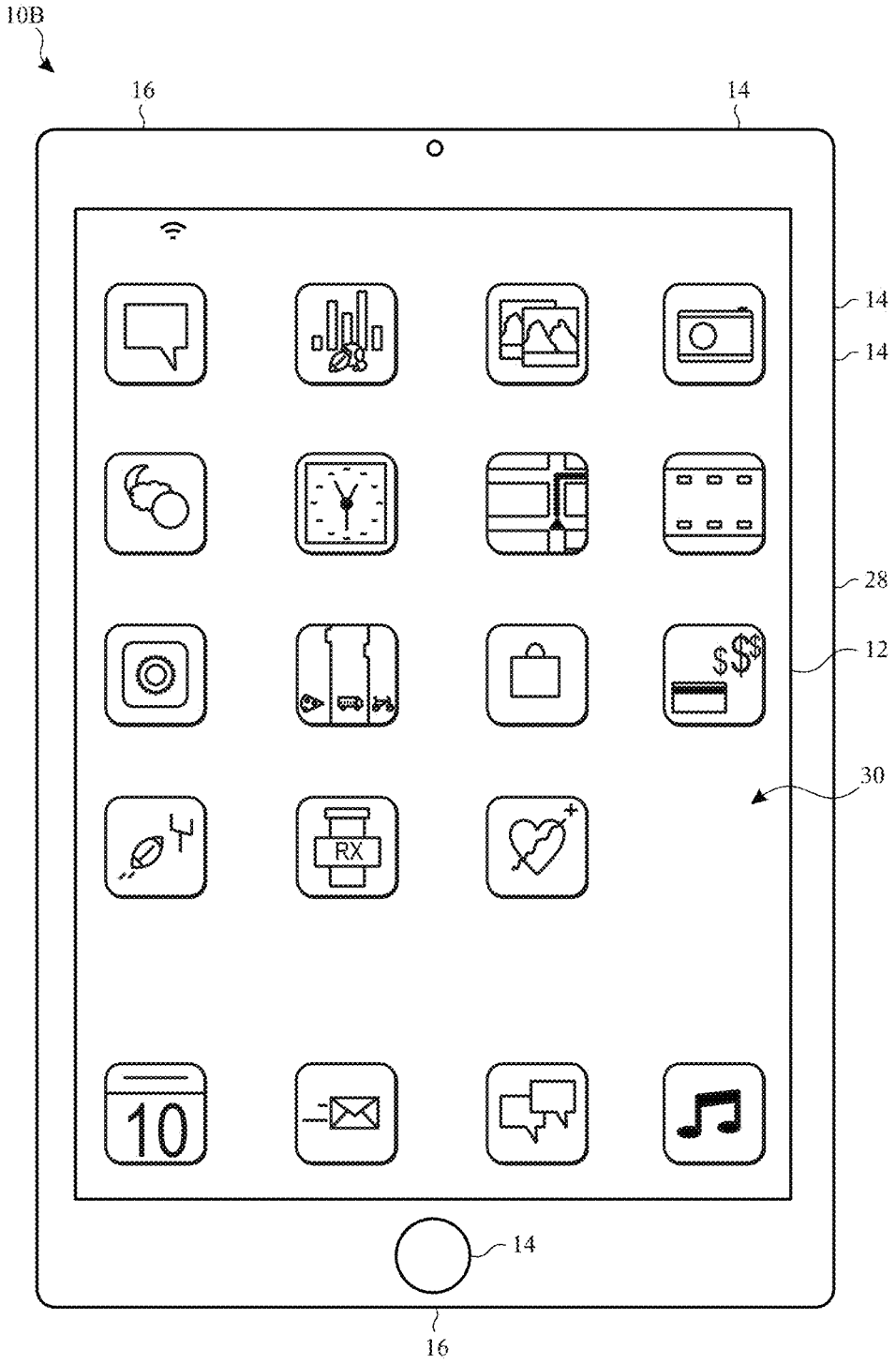
FIG. 3 is another example of the electronic device of FIG. 1, in accordance with an embodiment.
Figure 4:
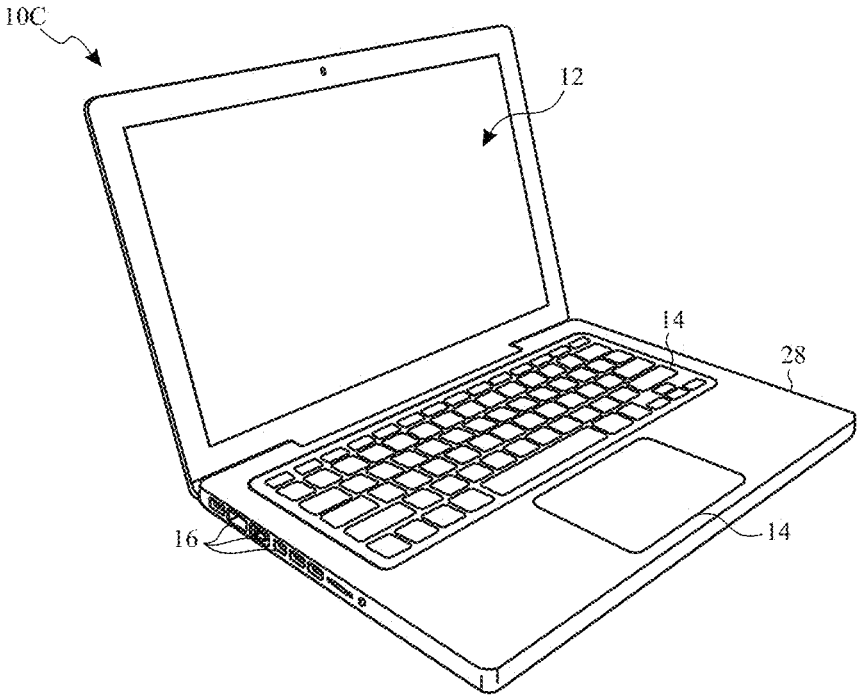
FIG. 4 is another example of the electronic device of FIG. 1, in accordance with an embodiment.
Figure 5:
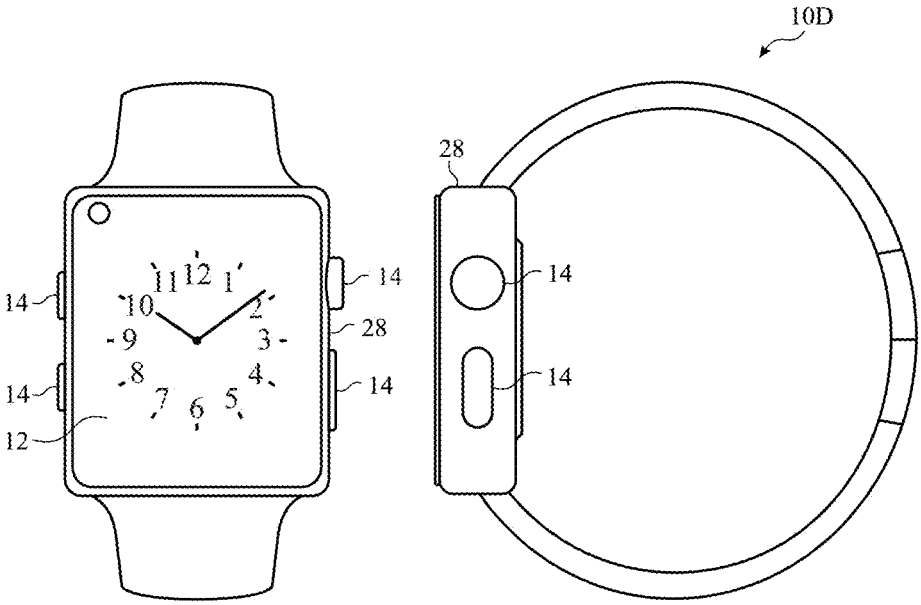
FIG. 5 is another example of the electronic device of FIG. 1, in accordance with an embodiment.

To further illustrate, another example of a suitable electronic device 10, specifically a tablet device 10B, is shown in FIG. 3. For illustrative purposes, the tablet device 10B may be any IPAD® model available from APPLE INC. A further example of a suitable electronic device 10, specifically a computer 10C, is shown in FIG. 4. For illustrative purposes, the computer 10C may be any MACBOOK® or IMAC® model available from APPLE INC. Another example of a suitable electronic device 10, specifically a watch 10D, is shown in FIG. 5. For illustrative purposes, the watch 10D may be any APPLE WATCH® model available from APPLE INC. As depicted, the tablet device 10B, the computer 10C, and the watch 10D each also includes an electronic display 12, input devices 14, I/O ports 16, and an enclosure 28.

As described above, the electronic display 12 may display images based at least in part on image data received, for example, from the processor core complex 18 and/or the image processing circuitry 27. Additionally, as described above, the image data may be processed before being used to display an image on the electronic display 12. In some embodiments, a display pipeline may process the image data, for example, based on gain values associated with corresponding pixel position to facilitate improving perceived image quality of the electronic display 12.

Figure 6:
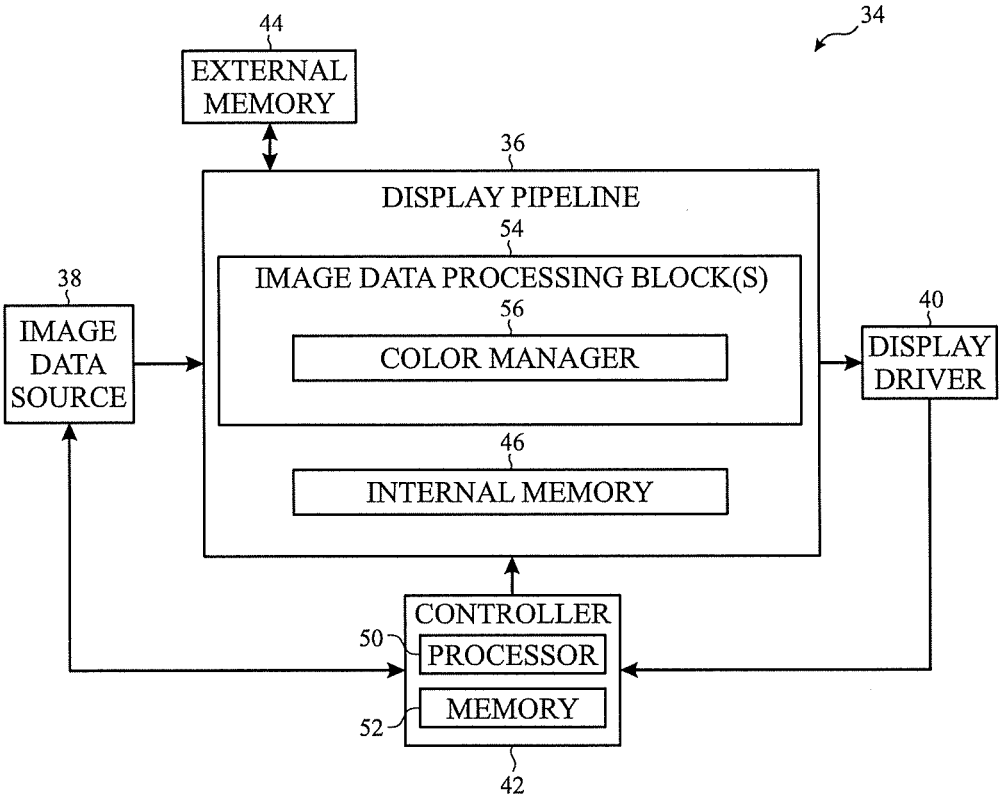
FIG. 6 is a block diagram of a display pipeline implemented in the electronic device of FIG. 1, in accordance with an embodiment.

To help illustrate, a portion 34 of the electronic device 10 including a display pipeline 36 is shown in FIG. 6. In some embodiments, the display pipeline 36 may be implemented by circuitry in the electronic device 10, circuitry in the electronic display 12, software running in the processor core complex 18, or a combination thereof. For example, the display pipeline 36 may be included in the processor core complex 18, the image processing circuitry 27, a timing controller (TCON) in the electronic display 12, or any combination thereof.

As depicted, the portion 34 of the electronic device 10 also includes an image data source 38, a display driver 40, a controller 42, and external memory 44. In some embodiments, the controller 42 may control operation of the display pipeline 36, the image data source 38, and/or the display driver 40. To facilitate controlling operation, the controller 42 may include a controller processor 50 and controller memory 52. In some embodiments, the controller processor 50 may execute instructions stored in the controller memory 52. Thus, in some embodiments, the controller processor 50 may be included in the processor core complex 18, the image processing circuitry 27, a timing controller in the electronic display 12, a separate processing module, or any combination thereof. Additionally, in some embodiments, the controller memory 52 may be included in the local memory 20, the main memory storage device 22, the external memory 44, internal memory 46 of the display pipeline 36, a separate tangible, non-transitory, computer readable medium, or any combination thereof.

In the depicted embodiment, the display pipeline 36 is communicatively coupled to the image data source 38. In this manner, the display pipeline 36 may receive image data corresponding with an image to be displayed on the electronic display 12 from the image data source 38, for example, in a source (e.g., RGB) format. In some embodiments, the image data source 38 may be included in the processor core complex 18, the image processing circuitry 27, or a combination thereof.

As described above, the display pipeline 36 may process the image data received from the image data source 38. To process the image data, the display pipeline 36 may include one or more image data processing blocks 54. For example, in the depicted embodiment, the image data processing blocks 54 include a color manager 56. Additionally or alternatively, the image data processing blocks 54 may include an ambient adaptive pixel (AAP) block, a dynamic pixel backlight (DPB) block, a white point correction (WPC) block, a subpixel layout compensation (SPLC) block, a burn-in compensation (BIC) block, a panel response correction (PRC) block, a dithering block, a subpixel uniformity compensation (SPUC) block, a content frame dependent duration (CDFD) block, an ambient light sensing (ALS) block, or any combination thereof. The color manager 56 controls and/or compensates color in the displayed image presented on the electronic display 12.

After processing, the display pipeline 36 may output processed image data, such as display pixel image data, to the display driver 40. Based at least in part on the processed image data, the display driver 40 may apply analog electrical signals to the display pixels of the electronic display 12 to display images in one or more image frames. In this manner, the display pipeline 36 may operate to facilitate providing visual representations of information on the electronic display 12.

Figure 7:
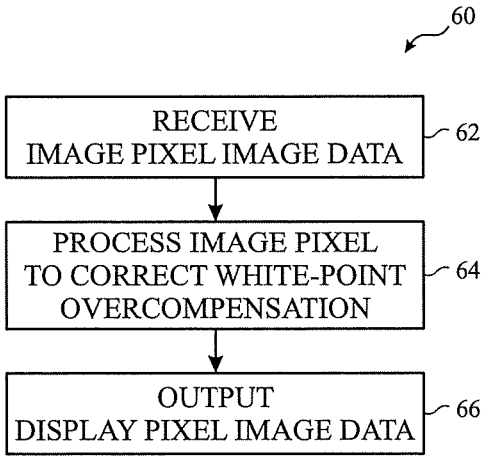
FIG. 7 is a flow diagram of a process for operating the display pipeline of FIG. 6, in accordance with an embodiment.

To help illustrate, one embodiment of a process 60 for operating the display pipeline 36 is described in FIG. 7. Generally, the process 60 includes receiving image pixel image data (block 62), processing the image pixel image data to determine display pixel image data (block 64), and outputting the display pixel image data (block 66). In some embodiments, the process 60 may be implemented based on circuit connections formed in the display pipeline 36. Additionally or alternatively, in some embodiments, the process 60 may be implemented by executing instructions stored in a tangible non-transitory computer-readable medium, such as the controller memory 52, using processing circuitry, such as the controller processor 50.

As described above, the display pipeline 36 may receive image pixel image data, which indicates target luminance of color components at points (e.g., image pixels) in an image, from the image data source 38 (block 62). In some embodiments, may include other display parameters, such as pixel greyscale levels, compensation settings, accessibility settings, brightness settings, and/or other factors that may change appearance of display. In some embodiments, the image pixel image data may be in a source format. For example, when the source format is an RGB format, image pixel image data may indicate target luminance of a red component, target luminance of a blue component, and target luminance of a green component at a corresponding pixel position.

Additionally, the controller 42 may instruct the display pipeline 36 to process the image pixel image data to determine display pixel image data to correct white point overcompensation (block 64) and output the display pixel image data to the display driver 40 (block 66). To determine the display pixel image data, the display pipeline 36 may convert image data from a source format to a display format based on the various display parameters. In some embodiments, the display pipeline 36 may determine the display format may be based at least in part on layout of subpixels in the electronic display 12. For example, the display pipeline 36 may use white-point compensation to compensate for current drop in the panel and also utilizing white-point correction to correct potential compensation of the white-point.

Figure 8:
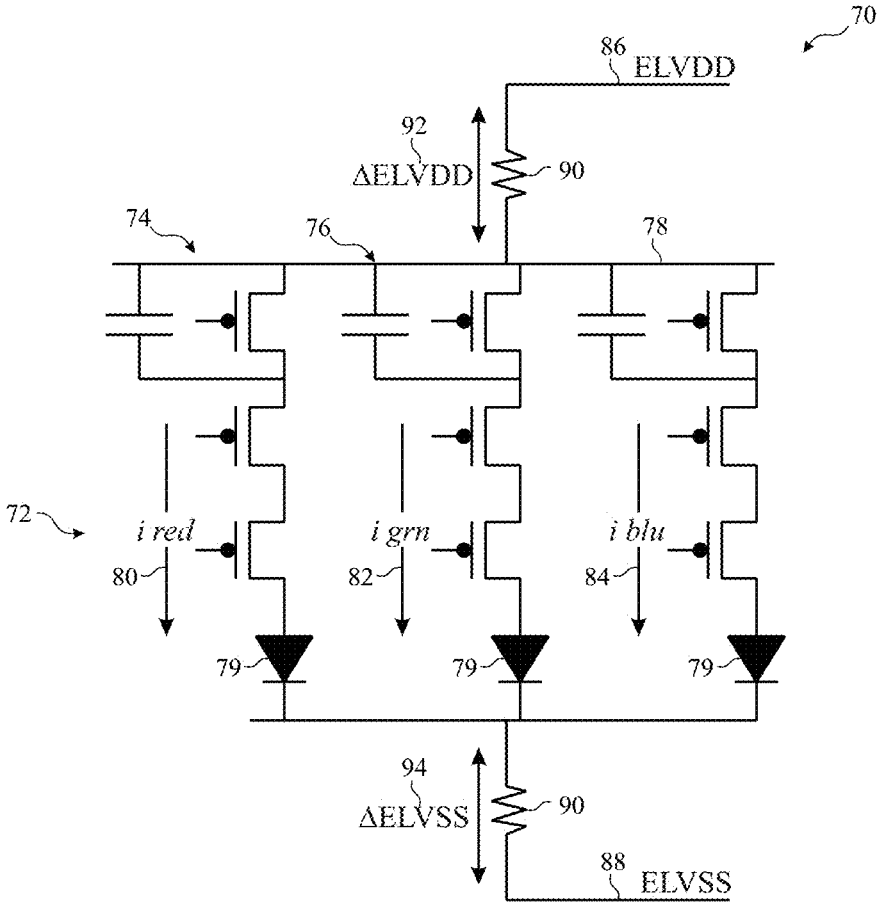
FIG. 8 is a schematic diagram of a portion of the electronic display of FIG. 1, in accordance with an embodiment.
Figure 9:
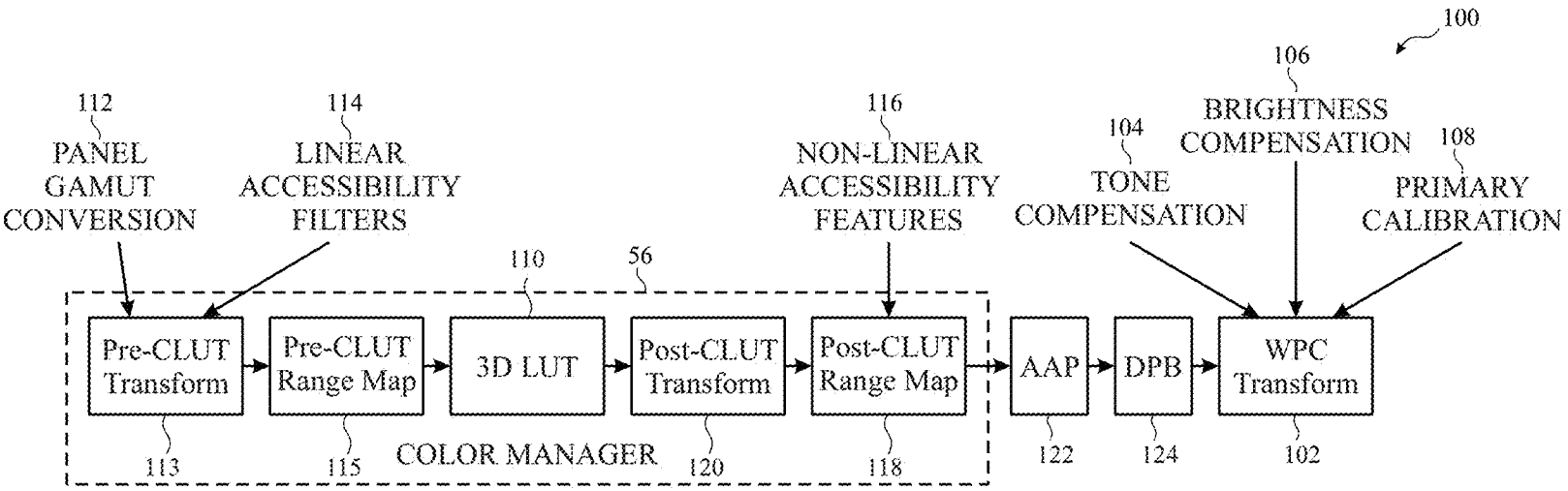
FIG. 9 is a block diagram of the display pipeline of FIG. 6 with white color compensation circuitry, in accordance with an embodiment.

To help illustrate white-point compensation and overcompensation correction, a portion 70 of the display 12 is presented in FIG. 8. The portion 70 includes a portion 72 of an active area of the display 12. The portion 72 includes a pixel that includes three subpixels 74, 76, and 78. In the illustrated embodiment, the subpixel 74 corresponds to a red subpixel, the subpixel 76 corresponds to a green subpixel, and the subpixel 78 corresponds to a blue subpixel. In other embodiments, subpixels may be arranged in different orientation and/or may correspond different colors than those represented in the portion 72. In some embodiments, a pixel (e.g., the portion 72) may include a different number of subpixels other than three.

This of pixels in that light using an emissive element 79. The emissive element 79 may include organic light-emitting diode (OLED) and/or any other emissive elements. An amount of light emitted from the emissive elements 79 is based on a respective current 80, 82, or 84. For example, the current 80 controls how much red light is emitted from a corresponding emissive element 79, the current 82 controls how much green light is emitted from a corresponding emissive element 79, and the current the four controls how much blue light is emitted from a corresponding emissive elements 79.

Amount of electricity going through the currents 80, 82, and 84 is controlled by voltage difference between ELVDD 86 and ELVSS 88. However, due to resistances 90 in the connections between a power supply (e.g., PMIC), the voltage across the portion 72 may be different than the difference between ELVDD 86 and ELVSS 88. In other words, ΔFLVDD 92 and ΔFLVSS 94 may cause a driving current (e.g., the current 80) through the corresponding emissive element 79 to be reduced. This reduction may be referred to as the current drop on the panel of the display 12.

To address current drop, the display pipeline 100 (e.g., display pipeline 36) attempts to compensate by tuning currents through the emissive elements 79 to produce a white point corresponding to a greyscale value of 255 of combining a maximum driving of the subpixels. This white point compensation performed in display pipeline 100, specifically, in a white point compensation transform block 102. This white point compensation transform block 102 may receive various parameters that control this compensation. For example, the white point compensation transform block 102 may utilize a tone compensation 104, brightness compensation 106, and primary calibration 108 to determine the white point for the display 12. The tone compensation 104 may compensate for ambient light (e.g., color and/or brightness). For example, the tone compensation 104 may be used to compensate for colors and brightness of ambient light to ensure that parents of the display image is the same between different ambient light conditions. Additionally or alternatively, the tone compensation 104 may be used to set certain tones for display images based on settings. For example, night mode may be used to reduce blue light emission by adjusting the white point determined from the white point compensation transform block 102. The brightness compensation 106 is based on a brightness setting that is used display 12. The primary calibration 108 may include panel specific calibration factors to correct for panel variability.

The color manager 56 may include a three-dimensional color lookup table (CLUT) 110 that is may be used to convert the image data from one format to another. The color manager 56 may also be used to convert image data into a suitable panel gamut (e.g., display range of colors) for the display 12 using panel gamut conversion parameters 112 in a pre-CLUT transformation block 113. The panel gamut conversion parameters 112 may include a palette of physical colors available for display using the display 12. The color manager 56, using the three-dimensional lookup table 110, may also be used for image data based on linear accessibility filters 114 and non-linear accessibility features 116. The linear accessibility filters 114 may include various linear filters the change in appearance of display data on the display 12. For example, these linear accessibility filters 114 may include color filters that adjusts the incoming data to compensate for color vision efficiency. For instance, the color filters may include a grayscale filter, a red/green filter for Protanopia, a green/red filter for Deuteranopia, a blue/yellow filter for Tritanopia, and/or other custom filters. Since these linear accessibility filters 114 are linear, these filters may be applied in the pre-CLUT transformation block 113 in the pipeline 100 before the CLUT 110. The color manager 56 may also include a pre-CLUT range map block 115 that maps colors from the image data to the CLUT 110.

The non-linear accessibility features 116 may include other accessibility features that are non-linear and change in appearance display data on the display 12. For example, the non-linear accessibility features 116 may include an inversion mode that inverts colors in the image data to aid in readability for those with certain vision deficiencies. These non-linear accessibility features may be applied in a post-CLUT range map 118 and/or a post-CLUT transform block 120.

The display pipeline 100 may include other processing blocks. For example, the illustrated embodiment of the display pipeline 100 and includes an ambient adaptive pixel (AAP) block 122 and a dynamic pixel backlight (DPB) block 124. The AAP block 122 may adjust pixel values in the image content in response to ambient conditions. The DPB block 124 may adjust backlight setting up backlight for the display 12 according to the image content. For example, in some embodiments, the DPB clock 124 may perform histogram equalization on image data and decrease the backlight output to reduce power consumption without changing appearance of the image data on the display 12.

Figure 10:
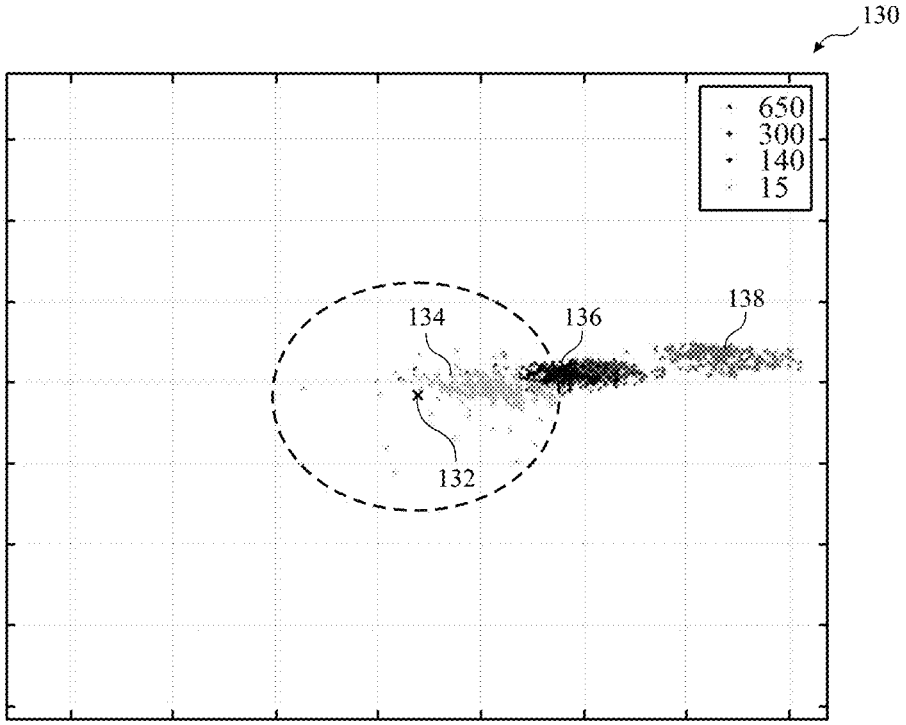
FIG. 10 is a graph illustrating color accuracy in the display pipeline of FIG. 9, in accordance with an embodiment.

Note that color accuracy of the display 12 is at least partially driven by white point compensation in the white point compensation transform block 102 (e.g., in a frame-by-frame basis). As previously noted, white point compensation using a white point (e.g., grayscale value 255 for multiple pixels) may address some issues with current drop. However, performing white point compensation based on the white point may cause oversaturation of nonwhite colors due to overcompensation since the compensation is based on the white point rather than the nonwhite color (e.g., R=0, G=100, and B=0). Moreover, color accuracy issues may be derived from cross-talk that changes (e.g., increases) an emission level away from a target value for the display as the emission target value increases. For example, FIG. 10 identifies a graph 130 that illustrates a color accuracy of a target color point 132. A first set of emission level points 134 may be relatively close to the target color point 132. A second set of luminance level points 136 may be a little bit further from the target color point 132. This larger variance results from a higher luminance level for the second set of luminance level points 136. And even higher level of luminance for a third set of luminance level points 138 causes the third set of luminance level points 138 to various greater distance from the target color point 132.

Figure 11:
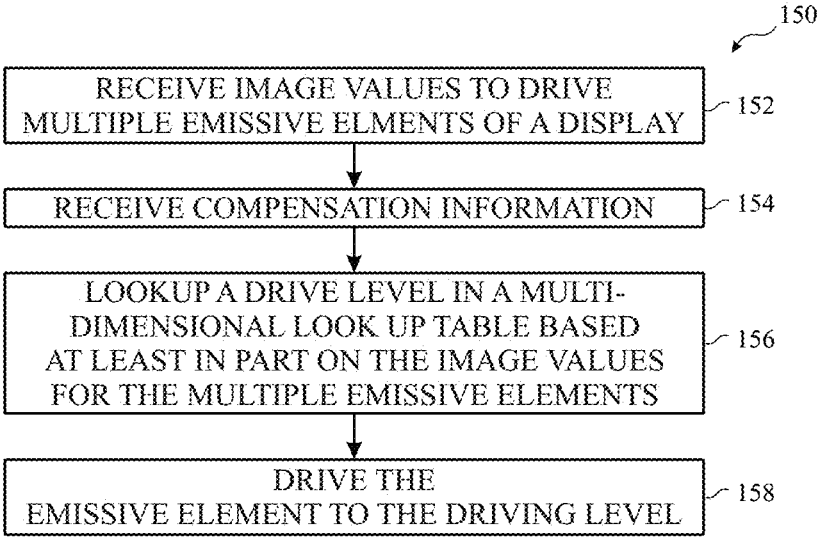
FIG. 11 is a flow diagram of a process that may be used to increase color accuracy in the display pipeline of FIG. 9, in accordance with an embodiment.

To address these issues, the display pipeline 36, 100 may utilize the three-dimensional CLUT 110 to modulate luminance of subpixels based on total current level in the display 12 and/or compensations for the data. In other words, modulation of a luminance level of a subpixel is a function of current through other channels. To aid in explanation, FIG. 11 illustrates a process 150 that may be used to increase color accuracy in the display 12 using the CLUT 110. The process 150 includes receiving image values to drive multiple emissive elements of the display 12 (block 152). These plurality of image values may be included in image data (e.g., a frame of video data) passed into the display pipeline 36, 100 and may correspond to current levels and/or voltage levels used to drive the emissive elements 79 to produce a corresponding greyscale level. In some embodiments, the display pipeline 36, 100 also receives compensation information (block 154). The compensation information may include accessibility settings, brightness compensations, panel-specific calibrations, tone compensation, and/or color oversaturation corrections. The brightness of a pixel may be used to determine a cross-talk compensation in the CLUT 110. This brightness (e.g., including the brightness compensation) may be used in a per-panel compensation. In other words, each panel may be characterized by 1) measuring the CLUT 110 for one or more brightness levels, 2) computing RGB values to map a given target to a measured color, 3) set linear mapping for gray levels (e.g., R=G=B) to preserve display driver integrated circuit calibration, and 4) checking integrity of the CLUT 110. In some embodiments, the CLUT 110 values may be averaged for multiple panels to address cross-talk.

The display pipeline 36, 100 then utilizes the CLUT 110 to lookup a driving level for an emissive element of the multiple emissive elements based at least in part on the driving values for the multiple emissive elements (block 156). By looking up a driving level for the emissive element (e.g., green subpixel) based on other emissive elements (e.g., red and blue subpixels), the effect on cross-talk on the display 12 may be reduced and/or eliminated. Additionally or alternatively to using multiple channel information to calculate driving levels of a single subpixel, in some embodiments, the lookup table may include the compensation information to correct for oversaturation and/or other compensation issues. The electronic device 10 then drives the emissive element to the driving level (block 158).

Figure 12:
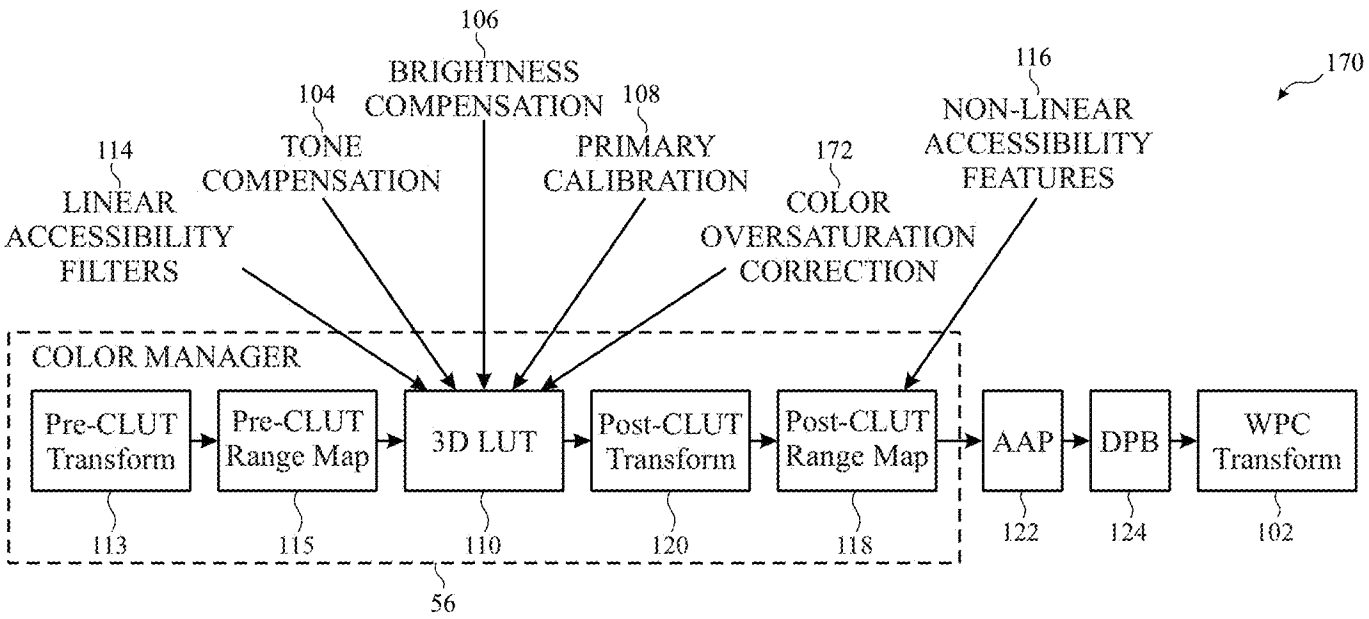
FIG. 12 a block diagram representing an embodiment of the display pipeline of FIG. 6 with increased color accuracy using a color lookup table (CLUT) to correct oversaturation and perform tone compensation, in accordance with an embodiment.

FIG. 12 illustrates an embodiment of a display pipeline 170 that utilizes a color oversaturation correction 172 to undo overcompensation that may be induced by the white point compensation transform block 102. In other words, the CLUT 110 may be populated with driving values indexed by incoming image values that take into account color oversaturation that would occur in the white point compensation transform block 102 to pre-compensate for such overcompensation. In the illustrated embodiment, the CLUT 110 is also populated according to the linear accessibility filters 114, the tone compensation 104, the brightness compensation 106, primary calibration 108, and/or other compensations/calibrations. By applying all of these compensations in the CLUT 110, panel-to-panel variation may be reduced. In some embodiments, the data in the CLUT 110 may be populated to compensate for cross-talk by taking into account of driving energy (e.g., currents and/or voltages) on other channels and/or the brightness compensation 106. In the illustrated embodiment, if any of the factors (e.g., tone compensation 104) changes, the CLUT 110 is recomputed. For example, in some embodiments, the CLUT 110 may include a 17×17×17 LUT that is entirely recalculated when the tone compensation 104 and/or the linear accessibility filters 114 are changed.

Figure 13:
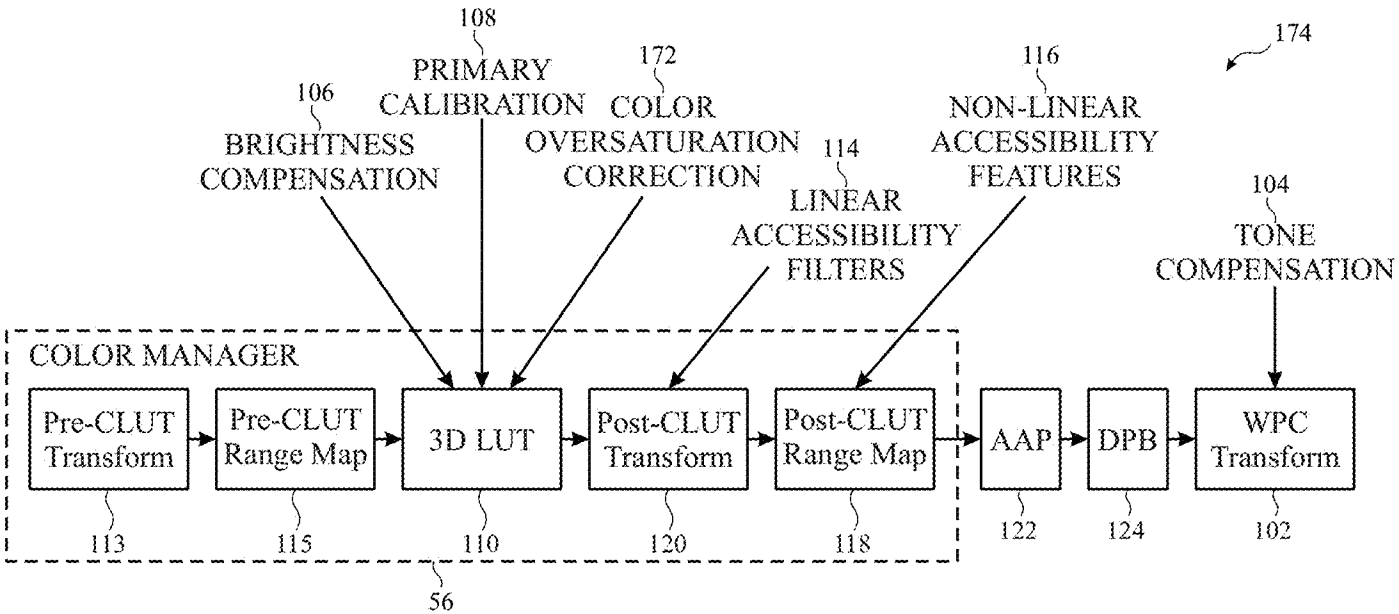
FIG. 13 a block diagram representing an embodiment of the display pipeline of FIG. 6 with increased color accuracy using a color lookup table (CLUT) to correct oversaturation and using white point compensation circuitry to perform tone compensation, in accordance with an embodiment.

FIG. 13 illustrates an embodiment of a display pipeline 174 that is similar to the display pipeline 170 except that the display pipeline 174 utilizes the white point compensation transform block 102 to perform tone compensation and utilizes the post-CLUT transform block 120 to process linear accessibility filters 114. By applying tone compensation 104 and linear accessibility filters 114 after utilizing the CLUT 110, calculation for different sets of LUT entries may be performed at boot with no recalculation needed when the linear accessibility filters 114, non-linear accessibility features 116, and/or the tone compensation 104 are changed. However, tone compensation 104 and/or linear accessibility filters 114 applied after primary calibration 108 may induce differences from panel-to-panel.

Figure 14:
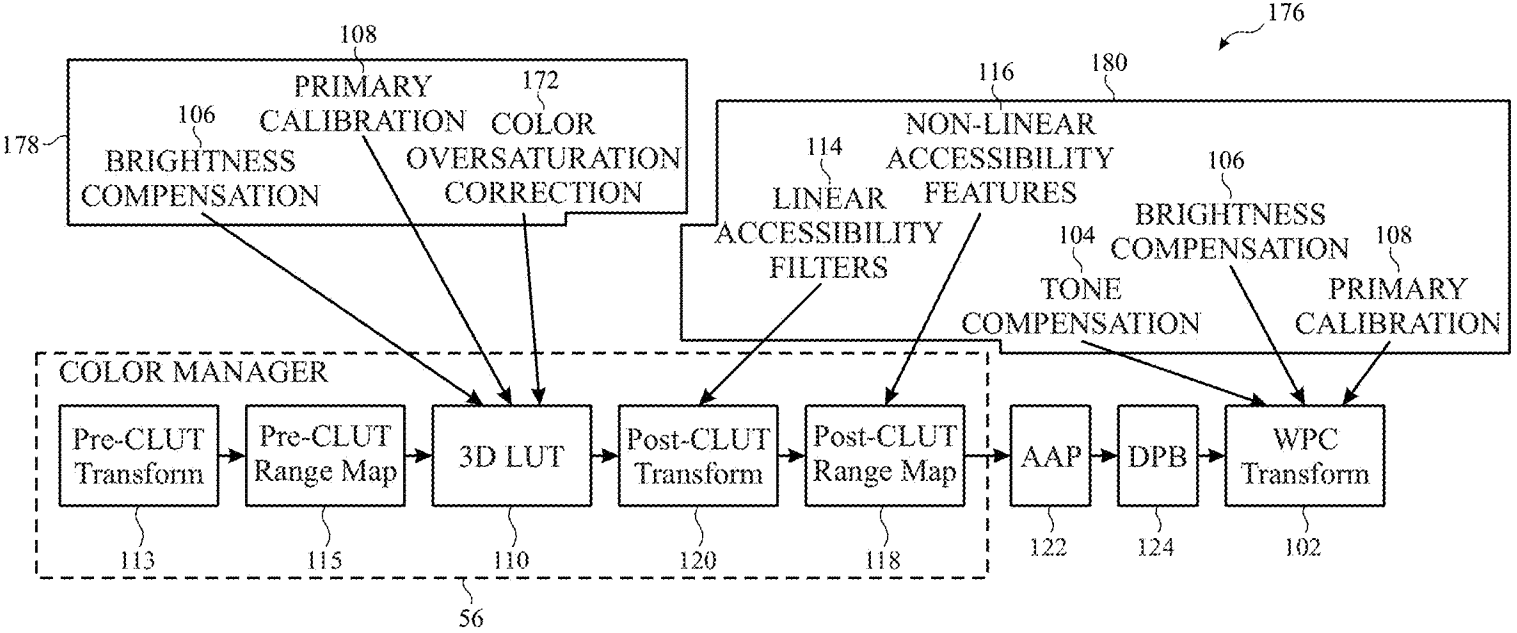
FIG. 14 a block diagram representing an embodiment of the display pipeline of FIG. 6 with increased color accuracy using a color lookup table (CLUT) to correct oversaturation mutually exclusive to tone compensation performed in white point compensation circuitry, in accordance with an embodiment.

FIG. 14 illustrates an embodiment of a display pipeline 176 that applies color oversaturation correction 172 mutually exclusive to tone compensation 104. In other words, the primary calibration 108 for the display 12 may be applied in a first portion 178 (e.g., in the CLUT 110) of the display pipeline 176 when tone compensation 104 and/or linear accessibility filters 114 are not applied to the image data. Alternatively, the primary calibration 108 may be applied in a second portion 180 of the display pipeline when tone compensation 104 and/or linear accessibility filters 114 are applied to the image data after the CLUT 110. This display pipeline 176 does not utilize repopulation of the CLUT 110 after changing the tone compensation 104 and/or the linear accessibility filters 114. Furthermore, since the CLUT 110 takes into account panel-to-panel variation via the primary calibration 108, variability from panel to panel may be reduced or eliminated. However, when tone compensation 104 and/or the linear accessibility filters 114 are applied, the resulting displayed image may suffer from saturated colors do to the color oversaturation correction 172 not being applied to these features.

Although the foregoing embodiments include using a three-dimensional CLUT, some embodiments may utilize a multi-dimensional CLUT that includes a different number of dimensions than three. For example, when a pixel includes a different number of subpixels (e.g., 4 subpixels RGBW), the CLUT may have a number of dimensions that match the number of subpixels in a pixel.

Furthermore, each of the display pipelines 100, 170, 174, and 176 include a CLUT 110 in a static location. However, in some embodiments, the CLUT 110 may be located at a different location in a display pipeline. For example, instead of using software compensation of cross-talk as previously discussed, the CLUT 110 may be moved closer to an end of the display pipeline to reduce cross-talk without convoluting the LUT data to deal with cross-talk.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic device, comprising:

an electronic display comprising a display region comprising a plurality of pixels each comprising a plurality of subpixels; and a display pipeline coupled to the electronic display, wherein the display pipeline is configured to:

receive image data;

perform white point compensation on the image data to compensate for a current drop in the display to cause the display to display a target white point when displaying white;

correct oversaturation of non-white pixels due to the white point compensation; and output the compensated and corrected image data to the electronic display to facilitate displaying the compensated and corrected image data on the display region.

2. The electronic device of claim 1, wherein the display pipeline comprises a multi-dimensional lookup table, and wherein correcting the oversaturation comprises looking up values in the multi-dimensional lookup table based at least in part on a color overcompensation correction value determined for the electronic display.

3. The electronic device of claim 2, wherein the multi-dimensional lookup table comprises a number of dimensions equal to a number of the subpixels corresponding to each pixel of the plurality of pixels.

4. The electronic device of claim 2, wherein the multi-dimensional lookup table is populated based on cross-talk compensation to compensate for cross-talk between the plurality of subpixels.

5. The electronic device of claim 4, wherein the cross-talk compensation for a first subpixel of the plurality of subpixels is based at least in part on driving levels for other subpixels of the plurality of subpixels.

6. The electronic device of claim 1, wherein the current drop comprises a reduced current through a subpixel based on resistances between a power supply and the display region.

7. The electronic device of claim 1, wherein correcting the overcompensation comprises pre-correcting for the white point compensation before performing white point compensation.

8. A method comprising:

receiving, in a display pipeline, a frame of video data to drive a plurality of emissive elements in an electronic display;

receiving compensation information for the frame of video data;

looking up, in a three-dimensional lookup table, converted driving values for an emissive element corresponding to the frame of video data, wherein the converted driving values are looked up based at least in part on values in the frame for other emissive elements of the plurality of emissive elements; and driving, via the display pipeline, the emissive element to the converted driving values.

9. The method of claim 8 comprising populating the three-dimensional lookup table to compensate for cross-talk between the plurality of emissive elements.

10. The method of claim 9, wherein populating the three-dimensional lookup table comprises:

measuring values for the three-dimensional lookup table for multiple brightness levels for the electronic display;

computing mapping to a given target from a measured color for the electronic display;

setting linear mapping for gray levels for the electronic display; and checking integrity of the three-dimensional lookup table for the electronic display.

11. The method of claim 10, wherein populating the three-dimensional lookup table comprises averaging three-dimensional lookup tables from a plurality of electronic displays.

12. The method of claim 10, wherein the gray levels comprise red pixel value equal to a green pixel value equal to a blue pixel value.

13. The method of claim 8, wherein the compensation information comprises white point compensation correction that corrects for oversaturation of nonwhite image values in the frame of video data.

14. The method of claim 8, wherein the compensation information comprises tone compensation that compensates for a display tone of the frame of video data based on ambient light.

15. The method of claim 14, wherein the tone compensation comprises compensation to adjust the display tone of the frame of video data based at least in part on a tone of the ambient light.

16. The method of claim 14, wherein the tone compensation comprises compensation to reduce blue light in the display tone of the frame of video data.

17. An electronic device comprising:

a display pipeline comprising:

a color manager configured to receive incoming image data, wherein the color manager comprises a multi-dimensional color lookup table configured to convert the incoming image data to converted image data; and white point compensation circuitry configured to produce a target white point for white values by compensating for a current drop in an electronic device in the converted image data, wherein the display pipeline is configured to correct for overcompensation of non-white pixels by the white point compensation circuitry.

18. The electronic device of claim 17, wherein correction for overcompensation of nonwhite pixels is performed in the multi-dimensional color lookup table, wherein the multi-dimensional color lookup table includes populated values based at least in part on tone compensation settings and linear accessibility filters, and wherein changing the tone compensation settings or the linear accessibility filters causes recomputation of the populated values.

19. The electronic device of claim 17, wherein correction for overcompensation of nonwhite pixels is performed in the multi-dimensional color lookup table, and tone compensation is performed in the white point compensation circuitry after the correction for overcompensation of nonwhite pixels is performed.

20. The electronic device of claim 17, wherein correction for overcompensation of nonwhite pixels is performed in the multi-dimensional color lookup table when a tone compensation mode is not set to compensate for tone related to ambient light in the white point compensation circuitry.

* * * * *